US006052931A

United States Patent [19]

Werner

[11] Patent Number: 6,052,931

[45] Date of Patent: Apr. 25, 2000

[54] TORQUE LIMITING DEVICE FOR PICTURN SIGNS

[76] Inventor: Paul H. Werner, 12301 E. McNichols, Detroit, Mich. 48205

[21] Appl. No.: 09/170,428

[22] Filed: Oct. 13, 1998

[51] Int. Cl.[7] ..... G09F 11/02

[52] U.S. Cl. ..... 40/505; 192/56.61; 74/665 GB; 464/37

[58] Field of Search ..... 40/503, 504, 505, 40/506, 507; 192/56.56, 56.61; 74/405, 665 GB; 464/30, 37, 42

[56] References Cited

U.S. PATENT DOCUMENTS

| | | | |
|---|---|---|---|
| 1,399,409 | 12/1921 | Sleder . | |
| 1,785,204 | 12/1930 | Nelson et al. . | |
| 3,273,271 | 9/1966 | Werner . | |
| 3,335,513 | 8/1967 | Mann | 40/505 |
| 3,387,394 | 6/1968 | Werner . | |
| 3,660,917 | 5/1972 | Bevan | 40/473 |
| 4,021,946 | 5/1977 | Bradshaw . | |
| 4,064,502 | 12/1977 | Saylor et al. . | |
| 4,771,558 | 9/1988 | Roberts et al. | 40/505 |
| 4,983,949 | 1/1991 | Wicker . | |
| 5,255,463 | 10/1993 | Werner | 40/505 |
| 5,255,465 | 10/1993 | Perez | 40/505 |
| 5,343,645 | 9/1994 | Huber | 40/505 |
| 5,412,893 | 5/1995 | Aiken, Sr. | 40/518 |
| 5,511,330 | 4/1996 | Havens | 40/505 |
| 5,860,325 | 1/1999 | Havens et al. | 40/505 X |

FOREIGN PATENT DOCUMENTS

| | | | |
|---|---|---|---|
| 2235328 | 2/1991 | United Kingdom | 40/505 |

*Primary Examiner*—Brian K. Green
*Attorney, Agent, or Firm*—Gifford, Krass, Groh, Sprinkle, Anderson & Citkowski, P.C.

[57] ABSTRACT

A rotating sign assembly has a plurality of rotatable, multi-sided, sign segments, a torque transmitting member which is rotatable about a first axis of rotation, a mechanism for rotatably driving the torque transmitting member, and a torque limiter. The torque limiter includes a pair of engagement members, one of which is fitted on the torque transmitting member so that it rotates with the torque transmitting member about the first axis of rotation. This first engagement member has a first engagement surface. The second engagement member operates to rotate one of the multi-sided sign segments and is supported for rotation about the first axis of rotation. This engagement member has a second engagement surface which is configured to abut the first engagement surface on the first engagement member. The torque limiter also includes a coupling which includes a projection on one of the engagement surfaces and a recess defined in the other engagement surface. The recess is positioned and shaped so that it engages the projection and so that when the recess engages the projection only a limited amount of torque can be transmitted from one of the engagement members to the other. When the limited amount of torque is exceeded, the projection disengages from the recess allowing one of the engagement members to rotate while the other engagement member remains stationary.

9 Claims, 2 Drawing Sheets

TORQUE LIMITING DEVICE FOR PICTURN SIGNS

FIELD OF THE INVENTION

The present invention relates generally to rotating sign assemblies and, more particularly, to a rotating sign assembly incorporating a torque limiting device to allow one or more sign segments to be stopped without stopping the drive mechanism.

BACKGROUND OF THE INVENTION

Roadside signs have long been effective means for advertising and conveying messages. Known billboard style signs are advantageous in that they successfully advertise a message to a broad audience for a relatively low price. However, these signs suffer from a severe disadvantage in that their display message may be posted for weeks or months limiting their effectiveness over the long term. The viewing audience simply becomes bored with the same inanimate sign displaying the same message, and its marketing effectiveness drops off significantly over time.

In response to conventional forms of billboard advertising, multi-sided, segmented, rotating signs were developed. These signs typically comprise a number of three-sided sign segments driven by a motor that selectively starts and stops or by a motor having some type of trip mechanism or clutch. One example of this type of sign is disclosed in U.S. Pat. No. 3,387,394.

Multi-sided, segmented, rotating signs are typically designed such that all of the segments rotate together and are not designed to allow one segment to remain stationary for an extended period. However, because these signs are often installed outside and exposed to the elements, one or more segments of the rotating sign may become jammed. This could occur due to dirt or debris becoming lodged around one of the segments or due to failure of the bearings that support the sign segment. To address this problem, currently existing rotating signs may include some type of "weak link" which is designed to fail if a sign segment becomes jammed. This "weak link" may be provided by constructing one of the drive gears from a softer material so that the gear fails in the event a segment becomes jammed. It is also possible to design the interconnection between a shaft and a gear to perform as a weak link or to form some portion of the drive mechanism, such as an interconnecting shaft, of a weak material so that it is the first to fail. Disadvantages to this approach are that a "weak link" is only capable of one failure and therefore is not resettable. Once the "weak link" fails, it is necessary to disassemble a portion of the sign and replace the part which has failed. A second disadvantage is that a "weak link" is typically not adjustable. It will always fail at approximately the same level of force independent of the application of the sign. To change the level of force required to make the "weak link" fail requires redesigning the "weak link" for the new application. Rotating signs come in a variety of sizes and are installed in a variety of conditions, and therefore the desirable force at which a weak link should fail may vary.

A second approach to allowing one sign segment to cease rotation is to limit the output of the drive motor. For example, it would be possible to use a drive motor with limited output torque and to wire the motor with a circuit breaker or fuse which will fail if the motor is unable to continue rotating the sign segments if it begins to overload or overheat. Like the "weak link," this approach suffers from a lack of resettability as well as limited adjustability. Unlike the "weak link" this approach stops all of the segments. Also, limiting the torque output of a drive motor may be undesirable as the total torque required to rotate the sign segments may vary dramatically depending upon weather conditions as well as the amount of wear in the total system. Therefore it makes it very difficult to predict what level of torque output is desirable. Therefore, there is a need for a device which allows one or more segments of a rotatable sign assembly to cease rotating and also provides for resettability and/or adjustability.

SUMMARY OF THE INVENTION

There is disclosed herein a rotating sign assembly which includes a plurality of rotatable, multi-sided, sign segments, a torque transmitting member which is rotatable about a first axis of rotation, and a means for rotatably driving the torque transmitting member. The sign assembly also has a torque limiter which includes a pair of engagement members, one of which is fitted on the torque transmitting member so that it rotates with the torque transmitting member about the first axis of rotation. This first engagement member has a first engagement surface. The second engagement member is supported for rotation about the first axis of rotation and has a second engagement surface which is configured to abut with the first engagement surface on the first engagement member. The torque limiter also includes a coupler including a projection on one of the engagement surfaces and a recess on the other engagement surface. The recess is positioned and shaped such that it engages the projection so that when the recess engages the projection, only a limited amount of torque can be transmitted from one of the engagement members to the other engagement member. When this limited amount of torque is exceeded, the projection disengages from the recess allowing one of the engagement members to rotate while the other engagement member remains stationary. The second engagement member operates to rotate one of the multi-sided sign segments.

DETAILED DESCRIPTION OF THE PREFERRED EMBODIMENT

Figure 1:
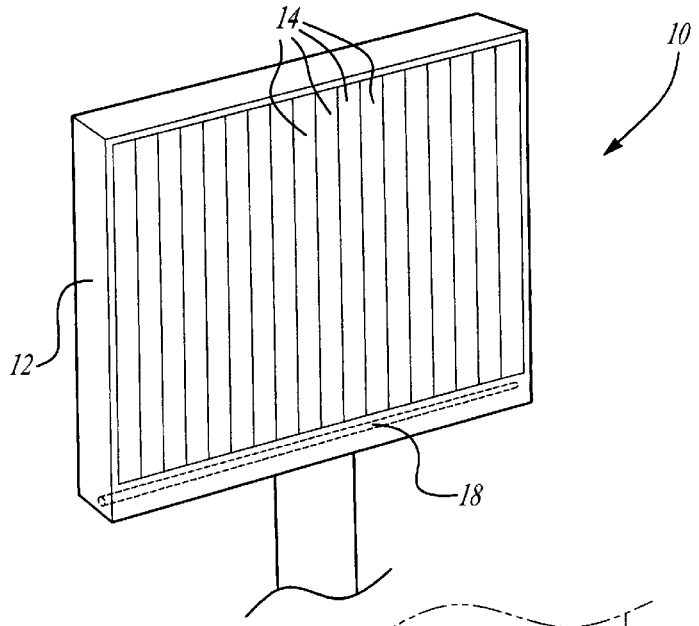
FIG. 1 is a perspective view of a rotating sign assembly according to the present invention.

Referring to FIG. 1, a rotating sign assembly according to the present invention is generally illustrated at 10. The rotating sign assembly 10 includes a perimeter frame 12 supporting a plurality of rotatable, multi-sided sign segments 14 arranged vertically side by side. In the preferred embodiment, each of the sign segments 14 has three sides joined together such that the sign segments 14 have a triangular cross-section. A portion of a sign segment 14 showing the triangular cross-section is illustrated in phantom in FIG. 2. Each of the three sides of the sign segments 14 are decorated with part of an advertising image. Referring to one side of each of the sign segments 14 as a first side, an advertising image is divided into multiple segments and one segment is placed on the first side of each sign segment 14. Then, when the multiple sign segments 14 are all rotated so that the first side of each is aligned so as to form an essentially continuous flat surface, the complete advertising image is displayed. As can be seen, a different advertising image can be divided among the segments on each of the three sides of the sign segments 14. Starting with the sign segments 14 positioned so as to display the first advertising image, rotating each of the segments 120 degrees clockwise will cause the multiple sign segments 14 to once again align to display a second advertising image. Rotating the segments 14 an additional 120 degrees will display the third advertising image and rotating the segments yet again will once again display the first advertising image.

Figure 2:
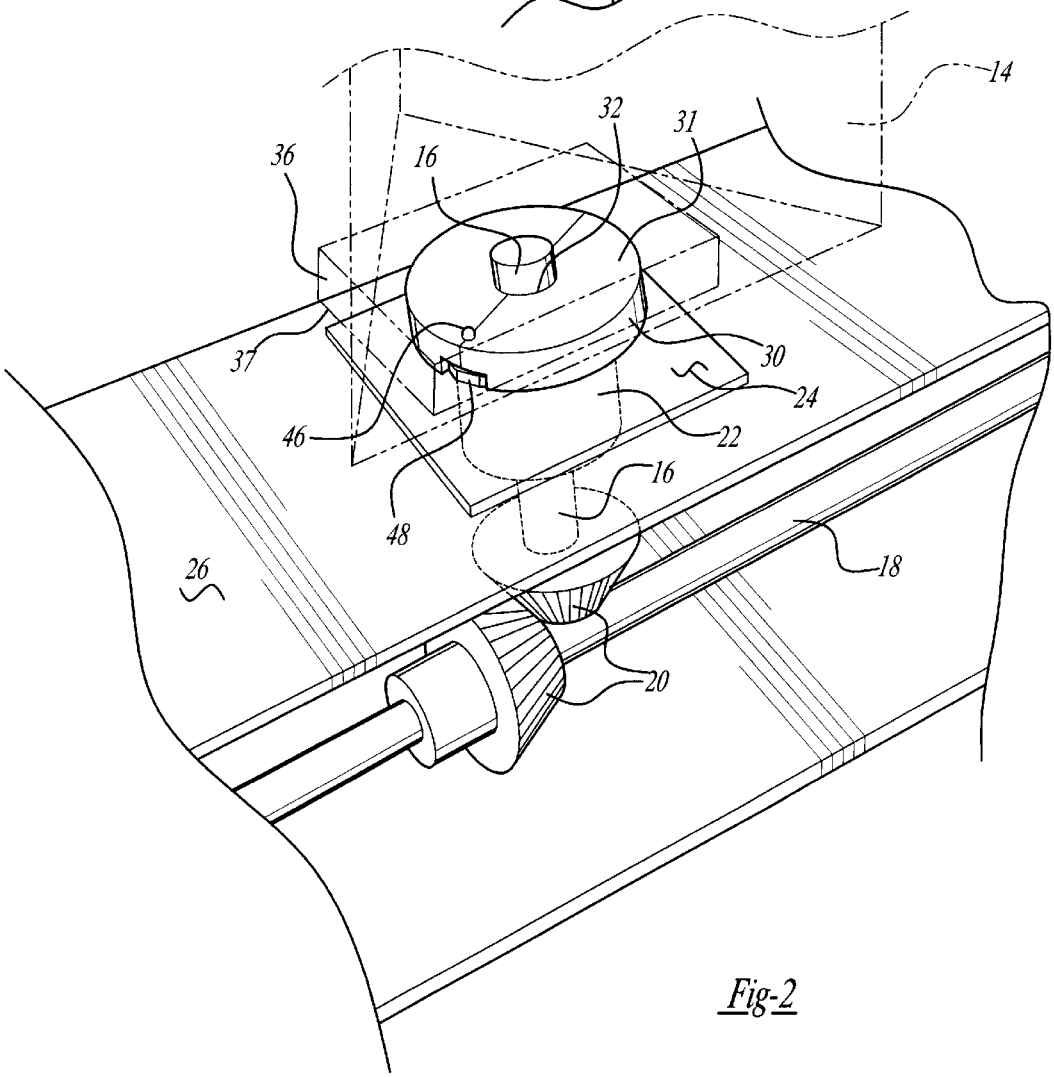
FIG. 2 is a sectioned, cut-away, perspective view of a portion of a rotating sign assembly according to the present invention.

Referring to FIGS. 1 and 2, the multiple sign segments 14 are rotatably driven by some type of torque transmitting member which in turn is rotatably driven by some type of drive means. In the illustrated embodiment, the torque transmitting member is a vertical shaft 16 which is rotatably driven by a drive shaft 18 through a pair of bevel gears 20. The drive shaft 18 is in turn driven by a motor, not shown. As will be clear to one of skill in the art, a torque transmitting vertical shaft 16 is provided for each of the multiple sign segments 14. The shafts 16 are each driven by the drive shaft 18 by bevel gears 20 at spaced intervals along the drive shaft 18. In traditional rotating sign assemblies, the torque transmitting vertical shaft 16 includes some type of interface for connecting with one end of a sign segment 14 so that rotation of the shaft 16 causes rotation of the associated sign segment 14. The normal operation of a rotating sign assembly 10 is interrupted if one of the multiple sign segments 14 becomes jammed, making it difficult to rotate. This may occur because dirt or debris becomes lodged around the sign segment 14 or because of wear in the system or failure of a bearing. In a traditional rotating sign assembly, when one sign segment 14 becomes jammed, the corresponding torque transmitting shaft 16 must also cease rotating. Because the torque transmitting shaft 16 is directly driven by the drive shaft 18, the drive shaft must also cease rotating unless some part of the system fails.

As shown in FIGS. 2–5, the rotating sign assembly 10 according to the present invention includes a torque limiter which allows an individual sign segment 14 to cease rotating without stopping rotation of the corresponding shaft 16. Also illustrated is a bearing assembly 22 for supporting a vertical shaft 16. The bearing assembly 22 is supported by a support member 24 which takes the form of a square steel plate with a hole therethrough. Bearing assembly 22 is fitted in the hole in the plate 24 and the plate 24 is in turn supported by a frame member 26 which forms a portion of the frame 12 of the sign assembly 10. The vertical shaft 16 passes through the bearing assembly 22 and is supported for rotation about a first axis of rotation A. The upper end of the shaft 16 extends a short distance above the top of the bearing assembly 22. As will be clear to one of skill in the art, the bearing assembly 22 may be of many designs. The bearing assembly 22 may also be supported in a variety of ways.

Returning now to the torque limiter portion of the present invention, the torque limiter includes a first engagement member 30. The first engagement member 30 is fitted on the vertical shaft 16 above the top of the bearing assembly 22 so that the first engagement member 30 rotates with the vertical shaft 16. In the preferred embodiment, the first engagement member 30 is a horizontal disk. The upper surface of the first engagement member 30 acts as a first engagement surface 31. The shaft 16 extends through and upwardly from the first engagement member 30. The disk is connected to the shaft 16 by an interference fit between a hole 32 in the disk and the shaft 16. Preferably, the first engagement member 30 has a cut in one side intersecting the hole 32 and extending outwardly therefrom. A bolt 34 passes from one side of the cut to the other so that tightening the bolt 34 causes the cut, and thereby the hole 32, to be tightened. As will be clear to one of skill in the art, there are many ways to interconnect the first engagement member 30 with the shaft 16 including but not limited to providing interlocking splines and teeth on the shaft 16 and the first engagement member 30. The illustrated embodiment, including the bolt 34, allows for easy assembly and disassembly and for adjustment in the rotational position of the first engagement member 30. Adjustment of the rotational position of the first engagement member 30 may be desirable to fine tune the position of the corresponding sign segment 14.

The torque limiter also includes a second engagement member 36. As shown, the second engagement member 36 is a rectangular plate which rests atop the first engagement member 30. The second engagement member 36, like the first engagement member 30, is positioned horizontally. The second engagement member 36 has a lower surface which acts a second engagement surface 37. The second engagement surface 37 abuts the first engagement surface 31 on the first engagement member 30. The second engagement member 36 also has a pilot hole 38 bored into the second engagement surface 37. This hole 38 is configured to accept the upper end of the vertical shaft 16 which extends through the first engagement member 30. Together, the first engagement member 30 and the vertical shaft 16 act to support the second engagement member 36 for rotation about the first axis of rotation.

The torque limiter also includes a coupling means for coupling the first engagement member 30 to the second engagement member 36. The coupling means includes a projection disposed on one of the engagement surfaces and a recess defined in the other engagement surface. In the preferred embodiment, the recess is a rounded depression 40 formed in the second engagement surface 37 of second engagement member 36. The first engagement member 30 has a threaded hole 42 defined therein. A threaded member 44 is supported in the threaded hole 42. An end 46 of the threaded member 44 extends from the first engagement surface of the first engagement member forming the projection of the coupling means. The end 46 is preferably rounded, having a radius similar to the rounded depression 40. The threaded member 44 is locked in place by a lock nut 48. The threaded hole 42 is positioned near the edge of the first engagement member 30 but alternatively can be positioned further away from the edge. The rounded depression 40 in the second engagement surface 37 is positioned so as to engage the end 46 of the threaded member 44. When the depression 40 engages the end 46, a limited amount of torque may be transmitted from the first engagement member 30 to the second engagement member 36. If this limited amount of torque is exceeded, the depression 40 will slip off of the end 46 allowing the second engagement member 36 to remain stationary as the first engagement member 30 continues rotating. The amount of torque required to disengage the depression 40 from the end 46 can be adjusted by moving the threaded member 44 up and down in the threaded hole 42 thereby adjusting how far the end 46 protrudes from the first engagement surface 31.

As will be clear to one of skill in the art, the end 46 and the depression 40 could have different shapes depending upon the amount of torque to be transmitted between the members 30, 36. It is also possible to form the projection and depression differently. For example, the first engagement member 30 could be formed with a projection on its upper surface rather than using an adjustable threaded member 44. It is also possible to have the projection positioned on the second engagement member and the recess positioned in the first engagement member 30.

Figure 3:
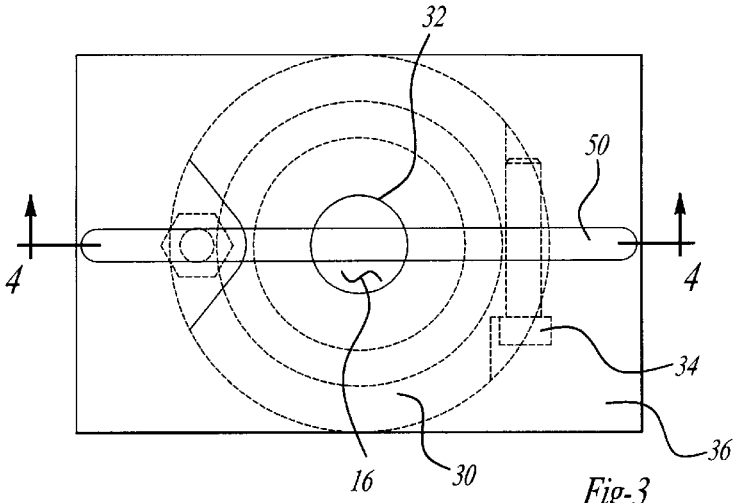
FIG. 3 is a top plan view of the torque limiter portion of the present invention.
Figure 4:
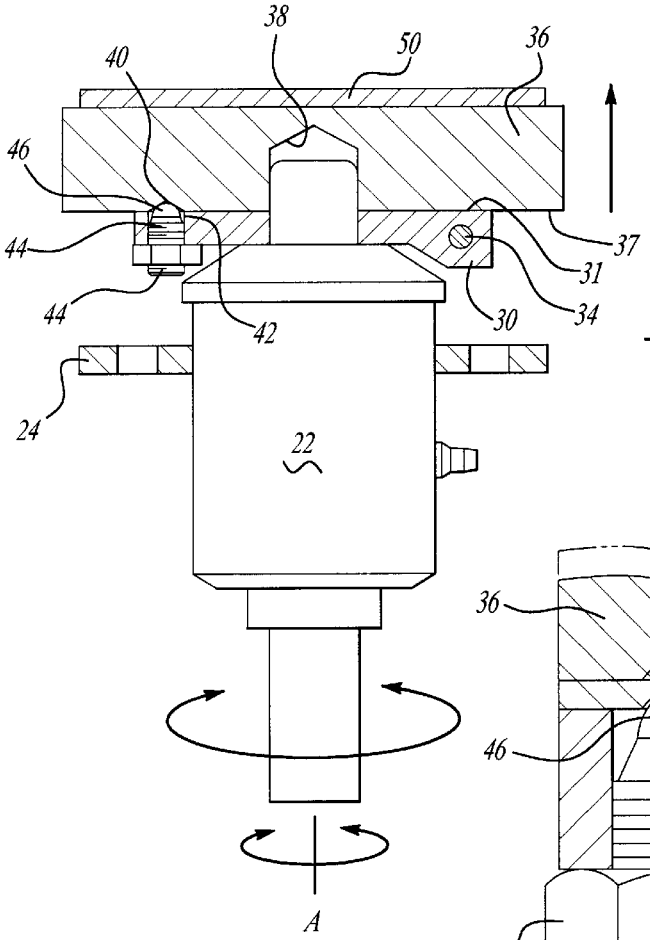
FIG. 4 is a sectional view of the torque limiter and torque transmitting member of the present invention taken along lines 4—4 of FIG. 3.

As best shown in FIGS. 3 and 4, the second engagement member 36 includes a fin 50 extending upwardly from the second engagement member away from the second engagement surface 37. It is preferred that the lower end of each of the sign segments 14 includes a slot defined therein. The fin 50 engages this slot so that rotation of the second engagement member 36 causes rotation of the corresponding sign segment 14. As will be clear to one of skill in the art, there are many ways for the second engagement member 36 to drive the corresponding sign segment 14. However, the fin and slot is advantageous because it allows easy and secure interconnection between the sign segment 14 and the second engagement member 36.

Figure 5:
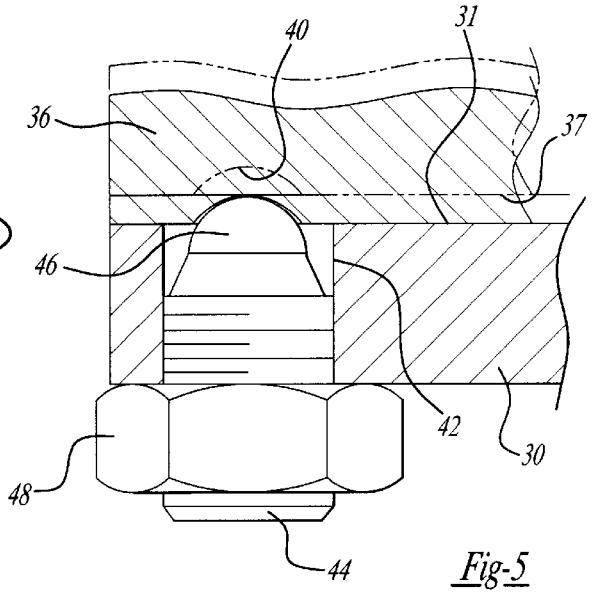
FIG. 5 is a closeup view of the coupling portion of the torque limiter shown in FIG. 4.

In operation, the vertical shaft 16 is rotated in 120 degree increments to rotate a corresponding sign segment 14 from one display message to the next. The shaft 16 rotates the first engagement member 30. Under normal circumstances, the rounded depression 40 is engaged with the end 46 of the threaded member 44 so that rotation of the first engagement member 30 causes rotation of the second engagement member 36. Rotation of the second engagement member 36 in turn causes rotation of the corresponding sign segment 14. If the sign segment 14 becomes jammed, the amount of torque required to rotate that segment 14 increases significantly. Therefore, the rounded depression 40 disengages the end 46 of the threaded member 44 allowing the first engagement member 30 to continue rotating as the second engagement member 36 remains stationary. As shown in FIG. 5, when the second engagement member disengages from the first engagement member 30, the second engagement member 36 moves upwardly as the rounded depression disengages from the rounded end 46. Because the engagement members are horizontal and the second engagement member 36 supports a sign segment 14, the weight of the sign segment 14 and the second engagement member tends to bias the second engagement surface 37 toward the first engagement surface 31. Therefore, for the rounded depression 40 to disengage from the rounded end 46 requires the second engagement member 36 to move upwardly against this weight. Alternatively, if the sign 10 were positioned differently, so that the weight of the sign segment did not bias the engagement members 30, 36 toward one another, a spring or other biasing member can be provided to bias the engagement members toward one another. After the rounded depression disengages from the rounded end 46, the first engagement member 30 continues to rotate until the depression 40 and the end 46 are once again lined up. At this point, the rounded depression 40 will re-engage the rounded end 46. If the sign segment was only temporarily jammed, and is now free to rotate, the first and second engagement members 30, 36 will once again rotate together. If, however, the sign segment 14 remains jammed, the rounded depression 40 will once again disengage from the rounded end 46 allowing the first engagement member 30 to rotate as the second engagement member 36 remains stationary. Once the jam is alleviated, due to a change in conditions or repair or cleaning, the first and second engagement members 30, 36 will once again rotate together.

In view of the teaching presented herein, other modifications and variations of the present invention will be readily apparent to those of skill in the art. The foregoing drawings, discussion, and description are illustrative of some embodiments of the present invention but are not meant to be limitations on the practice thereof It is the following claims, including all equivalents, which define the scope of the invention.

I claim:

1. A rotating sign assembly comprising:

a plurality of rotatable multi-sided sign segments;

a torque transmitting member rotatable about a first axis of rotation;

means for rotatably driving said torque transmitting member;

a torque limiter comprising:

a first engagement member fitted on said torque transmitting member for rotation therewith about said first axis of rotation, said first engagement member having a first engagement surface;

a second engagement member supported for rotation about said first axis of rotation and having a second engagement surface abutting said first engagement surface;

a coupling for coupling said engagement members comprising a projection disposed on one of said engagement surfaces and a recess defined in the other engagement surface, said recess positioned and shaped to engage said projection so that when said recess engages said projection only a limited amount of torque can be transmitted from one of said engagement members to the other engagement member and so that when said limited amount of torque is exceeded said projection disengages from said recess allowing one of said engagement members to rotate while the other engagement member remains stationary; said projection having adjustment means to permit an increase or decrease in said limited amount of torque allowed;

said second engagement member operable to rotate one of said multi-sided sign segments.

2. The rotating sign assembly of claim 1, wherein said second engagement member is supported by said torque transmitting member.

3. The rotating sign assembly of claim 1, wherein said torque transmitting member is a shaft.

4. The rotating sign assembly of claim 3, wherein said shaft extends from said first engagement member and said second engagement member has a pilot hole defined therein, said hole configured to accept said shaft, said second member being supported by said shaft.

5. The rotating sign assembly of claim 1, wherein said first axis of rotation is vertical.

6. The rotating sign assembly of claim 5, wherein said first and second engagement surfaces are horizontal.

7. The rotating sign assembly of claim 1, wherein said plurality of rotatable sign segments each include a lower end with a slot defined therein, and said second engagement member includes a fin extending away from said second engagement surface for engaging one of said slots.

8. A rotating sign assembly comprising:

a plurality of rotatable multi-sided sign segments;

a torque transmitting member rotatable about a first axis of rotation;

means for rotatably driving said torque transmitting member;

a torque limiter comprising:

a first engagement member fitted on said torque transmitting member for rotation therewith about said first axis of rotation, said first engagement member having a first engagement surface;

a second engagement member supported for rotation about said first axis of rotation and having a second engagement surface abutting said first engagement surface, said second engagement member operable to rotate one of said multi-sided sign segments;

said one of said first and second engagement members having a threaded hole defined therein;

a coupling for coupling said engagement members comprising a projection disposed on one of said engagement surfaces and a recess defined in the other engagement surface, said recess positioned and shaped to engage said projection so that when said recess engages said projection only a limited amount of torque can be transmitted from one of said engagement members to the other engagement member and so that when said limited amount of torque is exceeded said projection disengages from said recess allowing one of said engagement members to rotate while the other engagement member remains stationary; and a threaded member supported in said threaded hole, said projection comprising an end of said threaded member.

9. A rotating sign assembly comprising:

a plurality of rotatable multi-sided sign segments;

a torque transmitting member rotatable about a first axis of rotation;

means for rotatably driving said torque transmitting member;

a torque limiter comprising:

a first engagement member fitted on said torque transmitting member for rotation therewith about said first axis of rotation, said first engagement member having a first engagement surface;

a second engagement member supported for rotation about said first axis of rotation and having a second engagement surface abutting said first engagement surface, said second engagement member operable to rotate one of said multi-sided sign segments;

said one of said first and second engagement members having a threaded hole defined therein;

a coupling for coupling said engagement members comprising a projection disposed on one of said engagement surface and a recess defined in the other engagement surface, said recess positioned and shaped to engage said projection so that when said recess engages said projection only a limited amount of torque can be transmitted from one of said engagement members to the other engagement member and so that when said limited amount of torque is exceeded said projection disengages from said recess allowing one of said engagement members to rotate while the other engagement member remains stationary; and a rounded threaded member supported in said threaded hole, said projection comprising an end of said threaded member.

* * * * *